US005779537A

United States Patent [19]

Alden

[11] Patent Number: 5,779,537

[45] Date of Patent: Jul. 14, 1998

[54] DEPOSIT CUPBOARD FOR SOLVENTS, COMBUSTIBLE LIQUIDS AND THE LIKE

[76] Inventor: Jan Fritz Alden, Dusaviks,. 147, N-4007 Stavanger, Norway

[21] Appl. No.: 602,856

[22] PCT Filed: Aug. 24, 1994

[86] PCT No.: PCT/NO94/00136

§ 371 Date: Jul. 5, 1996

§ 102(e) Date: Jul. 5, 1996

[87] PCT Pub. No.: WO95/05763

PCT Pub. Date: Mar. 2, 1995

[30] Foreign Application Priority Data

Aug. 25, 1993 [NO] Norway ..... 933039

[51] Int. Cl.[6] ..... B24F 11/00

[52] U.S. Cl. ..... 454/239; 169/54; 169/56; 454/253; 454/342

[58] Field of Search ..... 454/49, 56, 57, 454/239, 253, 342; 169/54, 56, 60

[56] References Cited

U.S. PATENT DOCUMENTS

| | | | |
|---|---|---|---|
| 1,034,114 | 7/1912 | James . | |
| 2,783,845 | 3/1957 | Mathisen | 169/54 X |
| 4,243,773 | 1/1981 | Arnaud et al. | 525/387 |
| 4,625,627 | 12/1986 | Livanos et al. | 454/49 X |
| 4,928,583 | 5/1990 | Taylor et al. | 454/342 X |

FOREIGN PATENT DOCUMENTS

| | | | |
|---|---|---|---|
| 1459639 | 11/1966 | France . | |
| 2 369 811 | 7/1978 | France | 169/54 |
| 1554351 | 4/1970 | Germany . | |
| 3331331 | 10/1991 | Germany . | |
| 398485 | 12/1977 | Sweden . | |
| 429191 | 8/1983 | Sweden . | |
| 2115718 | 9/1983 | United Kingdom . | |

*Primary Examiner*—Harold Joyce
*Attorney, Agent, or Firm*—Hardaway Law Firm P.A.

[57] ABSTRACT

A deposit cupboard (1) for solvents, combustible liquids and the like, comprises shelves (2) and at least one door. The cupboard is assigned an air intake holes (20) and an exhaust device (5), and distinguishes itself through the following combination of features: a) that the shelves (2) of the cupboard (1) are perforated and/or positioned at a distance from at least one of the adjacent inner faces of the side walls of the cupboard, in order to effect a minimum resistance against the air flow; b) that the cupboard is assigned a fire extinguishing apparatus (18) having an automatic, preferably thermostat-controlled release means; and c) that the top plate (4) of the cupboard is pivotally supported and adapted—upon the occurrence of an explosion within the cupboard—to be swung limitedly up into a securing or protecting position, wherein it forms an inclinedly directed shield, protecting the personnel from the effects of the explosion.

10 Claims, 3 Drawing Sheets

DEPOSIT CUPBOARD FOR SOLVENTS, COMBUSTIBLE LIQUIDS AND THE LIKE

This invention relates to a deposit cupboard for keeping solvents, combustible liquids and the like, comprising shelves and at least one openable/closable, possibly lockable door as well as assigned an air inlet and exhaust device, and wherein the cupboard is assigned a fire extinguishing apparatus having an automatic, preferably thermostat-controlled release means.

In the most advanced deposit cupboards and cabinets for keeping solvents and the like, presently available on the market, the exhaust device is positioned at the top of the cupboard, more specifically laterally in the top plate of the cupboard, a built-in channel extending down to the bottom of the cupboard at the same side. The deposit cupboard is equipped with two usual round exhaust valves, one above and one below. These exhaust valves are substantially made in plastics. The air inlet is through the doors and through circumferential leakages. An explosion-proof fan provides the ventilation through a channel extending from the top of the cupboard, laterally thereof, and upwards above roof. The system is adapted to be permanently in operation, and comprises only an on-off switch, but has no automatic control device.

Through the positioning of the two exhaust valves, one above and one below, an optimally controllable exhaust air flow could not be achieved. Thus, caused through lacking control of the exhaust air, one could not prevent the formation of gas accumulations, especially within the middle zone of the cupboard, but also in other zones not reached by the air, and wherein, thus, no flowing has been effected.

Upon current break, cold/fresh air will ooze down through the channel system from the fresh air side, through the fan and into the cupboard through the two plastics valves. Thereby, gas accumulations in the cupboard are brought to ooze outwards through leakages in the cupboard, and this may cause unfortunate or damaging pollution of the environment around the solvent deposit cupboard. Gases from solvents are inflammable and may cause fire and explosion damages in addition to direct solvent damages on personnel staying in the neigbourhood of the cupboard in such a situation.

This known deposit cupboard for solvents and the like lacks in addition to a controllable exhaust means also devices for fire alarm, for fire extinguishing and for picking up sparks. Nor has the known cupboard a device for securing the personnel in case of an explosion in the cupboard.

Indeed, from DE patent specification No. 33 31 331 a deposit cupboard for i.a. solvents has been known, wherein the cupboard is assigned a fire extinguishing apparatus, but this cupboard also lacks a controllable exhaust device, a fire alarm device and a device for picking up sparks; nor does it have a device for securing the personnel in case of an explosion in the cupboard.

Therefore, the object of the present invention has been to eliminate or at least reduce these defects, disadvantages and limitations of use of prior art technique and, thus, provide a deposit cupboard for solvents and the like, wherein the formation of undesirable gas accumulations within the middle zones of the cupboard hardly may be formed, and wherein fire alarm and fire extinguishing devices are present within the cupboard, and wherein a safety device is adapted to come automatically into function as the result of a sudden pressure increase within the cupboard, caused by an explosion in the interior thereof.

Substantially, this object is realized through a combination of features, wherein the shelves of the cupboard are perforated and/or placed at a distance from at least one of the adjacent inner faces of the side walls (preferably all four) of the cupboard, and wherein the top plate of the cupboard is pivotally supported and adapted to—upon extremely high pressure conditions (explosion) within the cupboard—to be limited swung up to a securing or protecting position, in which it forms a shield, protecting the personnel.

The deposit cupboard for solvents and the like has, according to the invention, air inlets in the bottom of the cupboard where, moreover, a spark arrester may be disposed, further contributing to the fire safety of the cupboard.

At the exhaust device associated with the top plate of the cupboard, a perforated channel stub having a sealed bottom is suitably disposed. Uppermost, this channel stub is coupled to a flexible hose and is, internally, provided with a motor-controlled damper adapted to close the exhaust channel whenever the exhaust fan is stopped as a result of current break or the like. In the cupboard according to the invention, it is important to maintain optimally sealed packs around doors and bushings (i.a. the top plate and said channel stub in the top plate).

As a further security measure with regard to fire/explosion, it may be suitable to dispose a collecting vessel for liquid leakages above the lower bottom of the cupboard, apertures for air being formed in the outer vessel flange. These internal air apertures, which are included in an internal nozzle system, are, together with the exhaust device, adapted to keep the internal atmosphere of the cupboard at negative pressure conditions, corresponding to 80:100 (negative pressure, 80% of atmospheric pressure:exhaust 100%–intake 80%). The air flows through the perforations in the shelves og the slots between the shelf edges and adjacent inner faces of the cupboard side walls up to the lower edge of the top plate, where the air is sucked out through the perforated channel stub and, therefrom, out through said flexible hose which, at the other end thereof, may be coupled to a pipe line or channel having a silencer and a downstream suction fan (capacity e.g. 200 $m^3$/hour), eventually terminating within a jet hood.

The bottom of the perforated channel stub is tight in order to keep the exhaust air controlled from the top at the same time as the channel net is shielded upon the occurence of an explosion. Also, the tight channel stub bottom forms a reaction face which is subjected by high internal cupboard pressure (upon explosion), thereby contributing to the utilization of the pressure increase to swing the top plate into a position, wherein it protects the personnel against the effects from an explosion. In this securing or protecting position, the top plate may take an angle of e.g. 60° (to a vertical plane). Thereby, with a rectangular top plate, one side edge will be hinged to adjacent cupboard portion whilst, at the opposite side edge, a blocking means will be disposed, adapted to limit the top plate's degree of rotation.

Further objects, features and advantages of the solvent cupboard according to the invention appear from the following description of an example of a preferred embodiment diagrammatically illustrated in the accompanying drawings, wherein.

Figure 1:
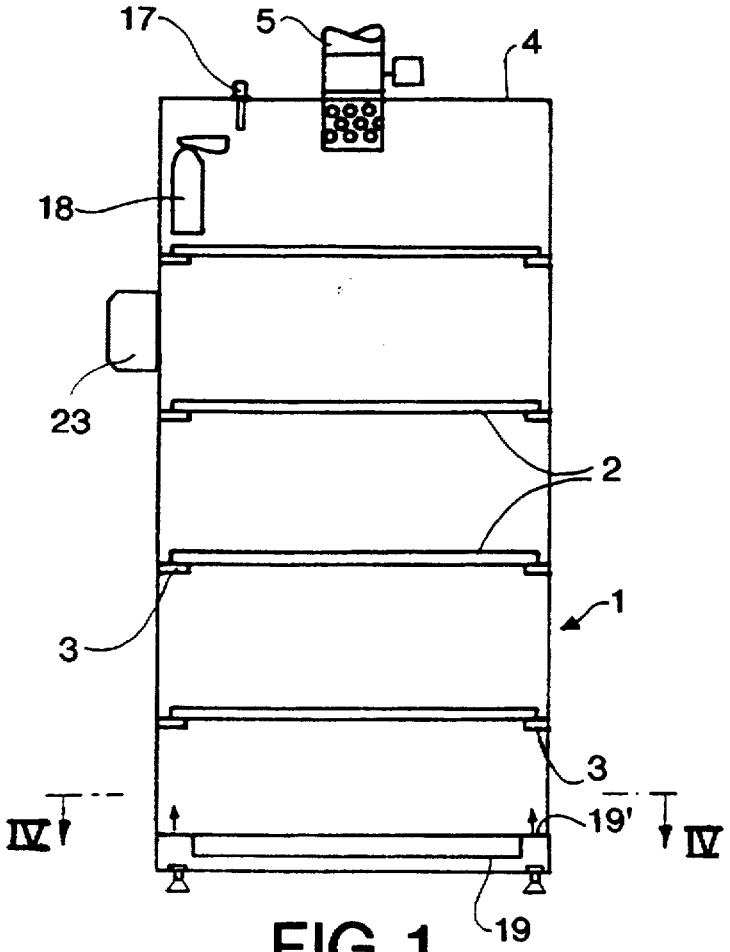
FIG. 1 shows a vertical cross-section through a solvent deposit cupboard according to the invention.
Figure 4:
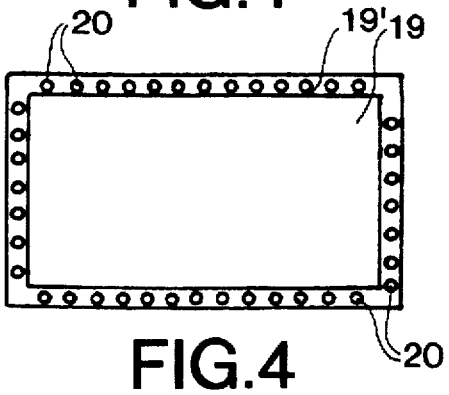
Figure 5:
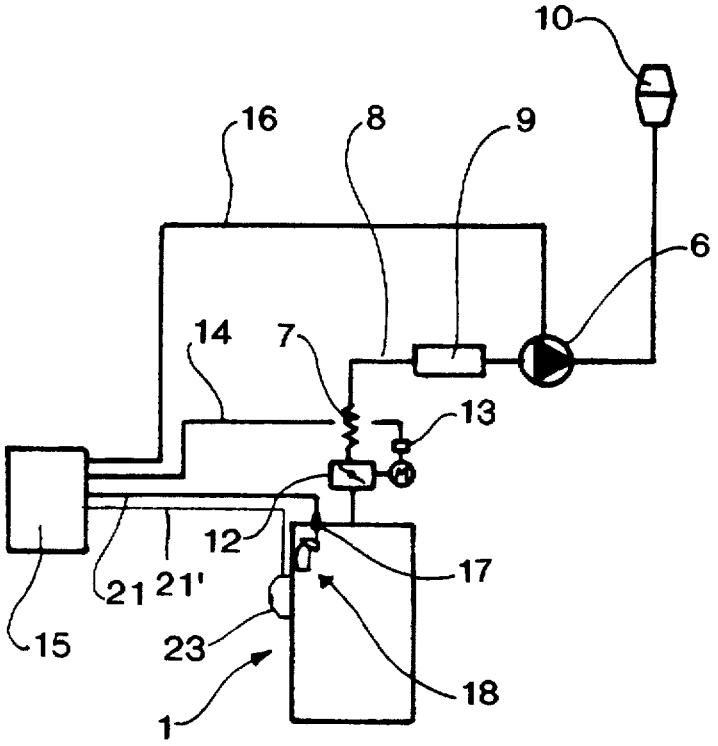

FIG. 4 shows a horizontal cross-section according to the line IV—IV in FIG. 1; and FIG. 5 shows a fundamental circuit diagram for the solvent deposit cupboard, with associated equipment.

Figure 2:
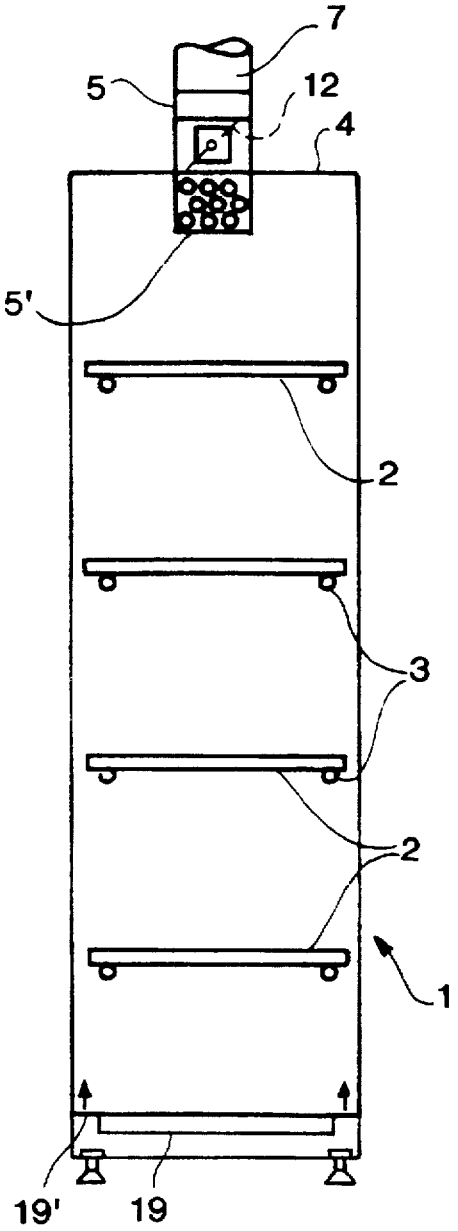
FIG. 2 shows, likewise, a vertical cross-section through the cupboard; here, in the horizontal plane, the plane of section forms an angle of 90° with the plane of section according to FIG. 1, and wherein the top plate with the perforated channel stub of the exhaust device is in ordinary operating position (no explosion in the cupboard)

The deposit cupboard for solvents and the like as shown in the drawings, is generally denoted with reference numeral 1. It is provided with a number of shelves 2 resting on adjustable shelf brackets 3. Uppermost the cupboard 1 has a top plate 4, which will be further described in the following. Preliminarily, it should be mentioned, as it appears in FIG. 2 in connection with FIG. 3, that the top plate 4 is rotatable in the vertical plane. Therefore, according to the invention, it is important to provide tight seals around the top plate and within the hinging thereof. Likewise, optimum tightness is maintained around the cupboard's doors, not shown.

In order to be capable of maintaining an intact flow of air from the lower air intake to the upper exhaust device, represented by a tight-bottomed, perforated exhaust stub 5 assigned a suction fan 6, FIG. 5, the shelves 2 are, partly, perforated, partly positioned at a distance from the inner faces of the side walls of the cupboard 1, so that zones are not formed in the inner middle portion of the cupboard, in which undesired gas accumulations may arise.

The exhaust stub 5 which is disposed with a circumferential seal in the pivotable top plate 4 of the cupboard i, is at the outer end thereof connected to a flexible hose piece 7 which, at the opposite end thereof, is coupled to a pipe line/channel 8, containing a silencer 9, and wherein the suction fan 6 is disposed, and which, eventually, terminates within a jet hood 10.

Figure 3:
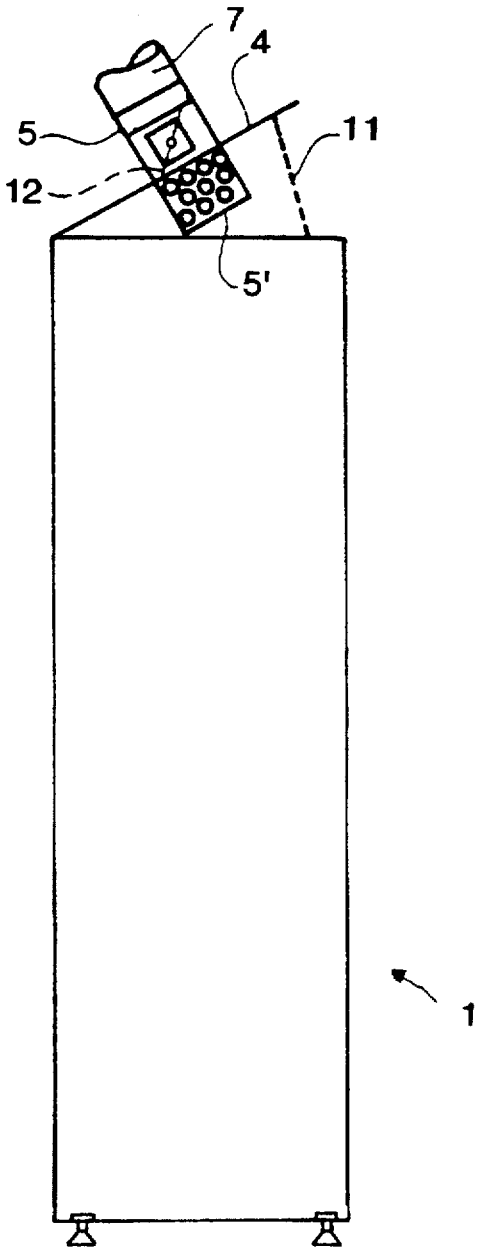
FIG. 3 shows a side elevation of the cupboard corresponding to the sectional drawing according to FIG. 2, but wherein the top plate together with exhaust stub—as the result of an extreme pressure increase within the cupboard (explosion or explosion-like condition)—has been swung up to an inclined position, wherein the top plate protects the personnel against the effects from explosion or possible simultaneous fire.

As mentioned, the top plate 4 is hinged at one side edge thereof, and is, at the opposite side edge, assigned a blocking means, e.g. in the form of a chain 11, for limiting the top plate's 4 pivotal movement (e.g. 60° with the vertical plane) when it—as the result of an explosion or extreme internal pressure conditions—swings to the inclined position shown in FIG. 3, where it is intended for the task of forming a shield for personnel in the neigbourhood, thus protecting these against the effects from the explosion.

Within the exhaust stub 5, a pivotable damper 12 is disposed, the latter being motor-controlled and adapted to close off the channel connection to the exhaust or suction fan 6 when the latter stands. The motor-controlled damper 12 is, through a connection box 13 in a conduit 14, connected to a control/automatics cabinet 15 known per se. An electrical conduit 16 connects the control/automatics cabinet 15 with the exhaust or suction fan 6.

It is mounted a fire alarm device 23 in the top of the cupboard. It is, preferably, thermostat-controlled, such a thermostat 17 being placed high above within the cupboard, FIGS. 1 and 5. The thermostat 17 may be set for 62°.

The deposit cupboard for solvents according to the invention is, likewise, equipped with a fire extinguishing apparatus 18 of its own, the latter having an automatic relase means which, also, may be thermostat-controlled; the thermostat may be set for 78°. It should be mentioned that the arrangement of a fire extinguishing apparatus having a thermostat-controlled release device in association with a deposit cupboard for solvents is not knew, a corresponding device being known from DE C2 33 31 331.

In the bottom area of the cupboard 1, a collecting vessel 19 for leakage liquid is disposed. The vessel 19 has a circumferential outwardly directed flange 19', which is formed with a large number throughgoing air intake holes 20. Beneath the vessel 19, the cupboard is formed with a more or less open bottom, securing the air intake.

From the thermostat 17 or the fire alarm device 23 associated therewith, respectively, a conduit 21 and 21' extends to the control/automatics cabinet 15.

The deposit cupboard for solvents and the like according to the invention is, preferably, based on operation at negative pressure conditions 80:100 (80% intake, 100% exhaust), and is secured a uniform air flow from the air intake holes 20 in the external flange of the vessel 19 within the bottom area of the cupboard 1. The air supplied flows with minimum resistance through the perforations of the shelves 2 and the slots between the shelf edges and the adjacent inner faces of the side walls of the cupboard, up to the top zone of the cupboard 1 just below the top plate 4, where the air is evacuated through the perforated exhaust stub 5 having the tight bottom 5'.

The tight bottom 51 of the exhaust stub 5 has a double function, in that a perforated stub having a tight bottom has been found to give a more controlled air evacuation, while the tight stub bottom 5' on the other hand forms a reaction surface upon pressure increase/explosion in the interior of the cupboard 1, thereby contributing to the swinging of the top plate 4 into the securing and protecting position as shown in FIG. 3, as previously described.

Also, the perforations of the shelves 2 serve another purpose, in that they facilitate the return of leakage liquid to the collecting vessel 19 in the bottom area of the cupboard.

I claim:

1. A storage apparatus for solvents and combustible materials comprising:

a cabinet having an interior storage area accessible through a closable door;

a fire extinguishing apparatus supported within an interior of said storage area, said fire extinguishing apparatus having an automatic activation means;

a plurality of shelves carried within said cabinet interior, said shelves defining a plurality of perforations, each said shelf positioned at a distance from at least one of an adjacent interior side wall of said cabinet;

a top plate of said cabinet having a hinged connection along a side of said top plate, said top plate adapted to opening upon the occurrence of a high pressure condition;

a restraint in communication with said top plate and said cabinet, said restraint limiting a size of said top plate opening wherein when said top plate is held in a fixed open position by said restraint, said top plate provides a protective shield for personnel in proximity to said cabinet.

2. The apparatus according to claim 1 wherein a thermostat is carried within an upper region of said cabinet, said thermostat in communication with an alarm means which is activated at a first elevated temperature.

3. The apparatus according to claim 2 characterized in that said thermostat, in response to a second elevated temperature, activates said fire extinguishing apparatus, said second temperature being higher than said first temperature.

4. The apparatus according to claim 1 wherein an exhaust device comprises an exhaust stub extending through the top plate, said exhaust stub having a sealed bottom and a perforated wall.

5. The apparatus according to claim 4 wherein said exhaust stub, in an area above the perforated wall, contains a motor-controlled damper which occupies a closed position in response to a deactivation of an exhaust fan.

6. The apparatus according to claim 1 wherein a bottom area of said cabinet provides an upwardly open collecting vessel for leakage liquids.

7. The apparatus according to claim 6 wherein said collecting vessel defines an upper circumferential, outwardly facing flange formed with a vertically through-going air intake hole.

8. The apparatus according to claim 1 wherein an air intake means and an exhaust means are adjusted in accordance with each other such that a negative pressure condition exists in the interior of the cover.

9. The apparatus according to claim 5 wherein a bottom area of said cabinet provides an upwardly open collecting vessel for leakage liquid.

10. The apparatus according to claim 7 wherein the air intake means and the exhaust means are adjusted in accordance with each other that a negative pressure condition exists in the interior of the cupboard.

* * * * *